United States Patent [19]

Tolmie

[11] 4,168,903

[45] Sep. 25, 1979

[54] FIRE DETECTING AND EXTINGUISHING SYSTEM FOR COPYING MACHINE

[75] Inventor: Robert J. Tolmie, Fairfield, Conn.

[73] Assignee: Pitney-Bowes, Inc., Stamford, Conn.

[21] Appl. No.: 937,781

[22] Filed: Aug. 29, 1978

[51] Int. Cl.[2] ..... G03G 15/00

[52] U.S. Cl. ..... 355/3 R; 219/216; 219/388; 340/506; 355/3 FU; 432/59

[58] Field of Search ..... 355/3 FU, 3 R, 14, 30, 355/133; 219/216, 388, 388 W; 432/59; 340/506, 510, 511

[56] References Cited

U.S. PATENT DOCUMENTS

| | | | |
|---|---|---|---|
| 2,781,705 | 2/1957 | Crumrine et al. | 355/3 R |
| 3,781,517 | 12/1973 | Skamra | 219/388 W X |
| 3,804,516 | 4/1974 | De Mott | 432/59 X |
| 4,034,186 | 7/1977 | Bestenreiner et al. | 219/388 X |
| 4,118,178 | 10/1978 | Calvi et al. | 355/3 FU X |

*Primary Examiner*—R. L. Moses

*Attorney, Agent, or Firm*—Martin D. Wittstein; William D. Soltow, Jr.; Albert W. Scribner

[57] ABSTRACT

An apparatus or system for detecting and extinguishing a fire originating in a fusing device or the like within a copying machine; means are provided for detecting the ionization of ambient air due to the existence of a flame within the fusing device, the ionization causing a substantial increase in the conduction of energy between a pair of flame detecting electrodes; the consequence is that the increased current causes an alarm to be given and/or automatically actuates a valve for ejecting a coolant or extinguishing chemical on the fire.

12 Claims, 7 Drawing Figures

FIRE DETECTING AND EXTINGUISHING SYSTEM FOR COPYING MACHINE

BACKGROUND OF THE INVENTION

1. Field of the Invention

The present invention pertains generally to xerographic printing and copying machines, and more particularly to a system or apparatus for detecting the presence of a fire in a fusing device within the copying machine and for automatically extinguishing such fire.

In accordance with well-known techniques in the xerographic printing and copying arts, an image bearing member, on the form of a photoconductive matrix, is charged to a substantially uniform level and, thereafter, is selectively discharged to provide an electrostatic latent image pattern in accordance with graphic material on an original document to be reproduced. The photoconductive matrix becomes discharged in the areas exposed to the illumination and retains its charge in the areas not so exposed, the latter corresponding to the graphic material on the original document. The latent image is developed by depositing toner particles, thereby resulting in a visible image which is then transferred to plain copy paper on other suitable substrate. The toner particles are a heat settable color thermoplastic powder and will electrostatically adhere to the image bearing member or to the final support material, being passed through a fuser which generates heat of sufficient intensity to permanently fix the toner particles in the desired image configuration.

Since most developing or toner materials used in plain paper electrostatographic copying are formed of thermoplastic materials which melt at fairly high temperatures, it is typical in practice to utilize a fusing device having a radiant energy source of heat which generates an extremely high temperature atmosphere in the area through which a sheet of copy paper passes. The extremely high temperature is necessary because the fusing of the developing material must take place while the sheet of paper is moving through the fuser and a given segment of developing material is exposed to the source of heat for only a brief period of time. Since the temperature of the atmosphere immediately adjacent the paper exceeds the ignition temperature of the paper, it is clear that the paper will catch fire as a result of almost spontaneous combustion should, for example, the sheet of paper stop its movement within the fuser. This situation could be very dangerous since other parts of the copying machine could catch fire from the burning paper which is only partly enclosed within the fuser, thereby resulting in extensive damage. If the burning sheet were not contained within the machine, it could be transported into the catch tray which might contain copies previously deposited, whereby the tray could catch fire and possibly cause great damage to the surrounding environment as well as causing injury to the machine operator.

Accordingly, it is the primary object of the present invention to improve the safe operation of fusing devices in copying machines by efficiently detecting the outbreak of fire, such as when a copy sheet begins to burn.

2. The Prior Art

The above-described problem has long been recognized in the electrostatographic copying field as well as in the field of motion picture projection. In the latter case it is known, for example, from U.S. Pat. No. 1,845,840 to provide a restricted passageway through which the motion picture film is drawn while passing through a projector so that if the film should catch fire for any reason, the fire will be choked or snuffed out due to lack of oxygen within the confined space of the restricted passageway.

In the copying field, a variety of approaches have been taken in order to overcome the problem with fire in the fusing devices of the various types of copying machines. For example, in U.S. Pat. No. 3,357,401 an air jet detector is utilized to detect the presence of a copy sheet exiting from the fusing device. In the event that the copy sheet jams in the fusing device and fails to exit therefrom, an electric circuit responsive to the combined effects of the air jet and a timer operates to energize a fire extinguishing system.

In U.S. Pat. No. 3,705,289, a bridge circuit is utilized to detect temperature in the fuser above a predetermined limit to automatically terminate the operation of the fuser while allowing a ventilator to continue to operate. The bridge circuit continuously monitors the fuser to assure that the temperature remains within predetermined limits.

In U.S. Pat. No. 3,804,516, a similar type of electric bridge circuit is utilized to detect the presence of a fire in the fuser by measuring any variation in the temperature resulting from a burning sheet in order to generate an output signal to warn the operator of the existence of the fire in the machine.

In U.S. Pat. No. 3,748,088 a mechanical device is utilized to measure the velocity of the copy paper traveling through the fuser and any variation from a predetermined velocity is electronically sensed to activate appropriate controls to de-energize the source of heat in the fuser to prevent the copy sheet from catching fire.

In U.S. Pat. No. 3,778,222 a fusing apparatus includes a means for sensing the presence of fire, in response to which suitable mechanical means operate to enclose the passageway of the copy sheet through the fusing device thereby preventing spread of the fire from the fusing device.

Most recently in U.S. Pat. No. 3,979,161 a fusing apparatus in an electrostatographic copier includes a fire extinguishing snuffer device located somewhat downstream from the heat radiating portion of the fuser so that in the event of combustion of the copy sheet the flames will be extinguished by the copy sheet passing between closely spaced plates of the snuffing device.

Although the problem of fire in the fusing device has been met in accordance with the variety of approaches disclosed in the above-cited patents, it turns out that, although most of these approaches have merit in one way or another, they are not ideally suited to work in high ambient temperatures, nor is their response time as rapid as required.

Accordingly, it is another primary object of the present invention to provide a quick acting fire detecting and extinguishing system for a copying machine and further to provide one that is low in cost and simple to make.

Another important object of the present invention is to provide that the detection is not dependent on the rate or rise of temperature or on reaching the melting point of fusable wires or the like, but instead will operate instantaneously upon detection of flame. The principle upon which the present invention operates is the ionization of ambient air due to the presence of flame which will cause a substantial increase in conduction between a pair of flame detector electrodes.

Although the broad principle of flame ionization has been known in fire detecting systems such as, for example, in U.S. Pat. No. 2,385,976 to Evans et al, such principle has not been effectively exploited in a copying machine environment. Other examples of flame ionization detectors are those described in U.S. Pat. Nos. 3,551,908 and 3,740,574. In the last-cited patent, the system operates such that the flame itself generates an AC signal when a DC source is impressed between flame detecting electrodes and the flame monitor therein is sensitive to AC signals appearing across the flame electrodes above a certain frequency or above a certain voltage so as to indicate flame presence. However, that system is directed to continuously monitoring the desired condition, namely, the presence of a flame and for giving an alarm only in the situation where the flame does not appear. To the same general purpose in the system disclosed in U.S. Pat. No. 3,551,908, which is directed to utilizing the ionization pattern of a flame gas to modulate a low voltage carrier signal impressed between a sender electrode and a receiver electrode. The resultant modulating signal at the receiver electrode is used to gate a latching switch, such as an SCR, which actuates an output switch to a readout device so as to indicate flame presence. In this case, also, the crucial concern is the existence of a flame, the absence of such flame being abnormal and being arranged to give an alarm signal. In other words, it is flame failure that is to be indicated by an appropriate alarm.

In contrast with the above-noted patents, and in particular, U.S. Pat. No. 3,551,908 and 3,740,574, it is the purpose and objective of the present invention to continuously provide to a transmitting electrode a pulsating signal, preferably having a frequency of the order of 300 cycles per second. Such signal is received by the receiving electrode to an insubstantial degree unless and until the critical situation is present, that is, a flame surrounds the electrodes so as substantially to ionize the ambient and so reduce the impedance of the conduction path between electrodes, whereby the signal is then substantially transmitted to the receiving electrode. In this latter case, the signal received is approximately one thousand times as great as the signal flowing when the gap between the electrodes is not bridged by flame and is, therefore, not ionized. Appropriate threshold means, included as part of input amplifiers, detect whether the signal received is sufficiently great to constitute an alarm condition.

Briefly described, a primary feature of the present invention resides in a flame ionization detection system for detecting a flame in an electrostatic copying machine, such system comprising means defining a path of travel for a copy sheet; first and second electrodes operatively associated with said travel path and spaced closely adjacent thereto for detecting any ionization resulting from a flame occurring adjacent the path of travel; signal generating means coupled to said first electrode for generating pulse signals having a predetermined magnitude and frequency; signal receiving means coupled to said second electrode for receiving signals therefrom; and comparator means coupled to said signal generating means and to said signal receiving means for determining if the received pulse signals are above or below a threshold level and so correspond in all respects to the pulse signals transmitted to said first electrode that they are indeed flame indicating.

It will be appreciated from the preceding definition of the primary feature of the present invention that the combination includes in effect a verification or self-checking means; that is, a means that continuously compares the magnitude and frequency of the received signal to the transmitted signal, thereby to insure that the received signal is not a spurious signal but is indeed indicating the presence of a flame.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
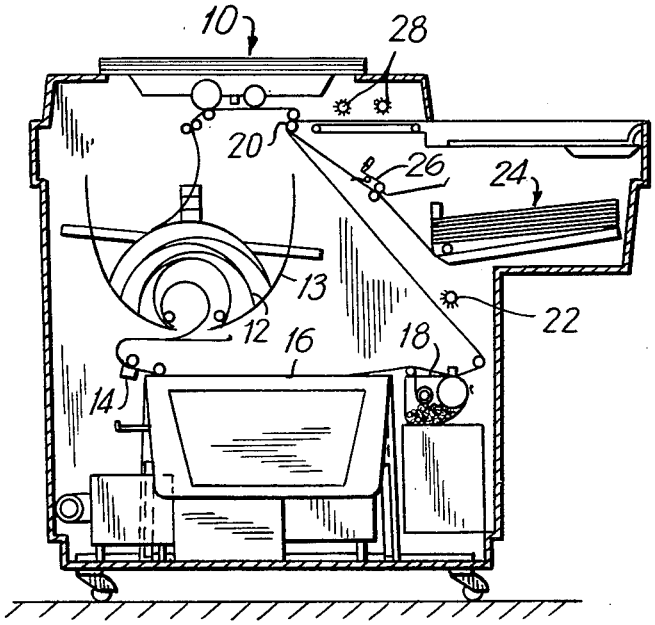
FIG. 1 is a diagrammatic view of a conventional xerographic or electrostatographic copying machine in which some of the principal parts involved in the copying process are illustrated.

Before proceeding with a description of a preferred embodiment of the present invention, reference will be made first to FIG. 1 of the drawing in which a digrammatic view is presented in side elevation of the principal parts of the equipment utilized in a well-known electrostatic copying process. It will be understood that an original document is positioned under the cover 10 of the machine and, after a PRINT button or the like has been pressed to activate a main switch, a section of photoconductive matrix 12 is transported out of its hopper 13 and through the machine, passing a charger unit 14. The charged section of the photoconductive matrix then passes over a projection area 16, and a reflected image is projected via a lens and mirrors, not seen, onto the charged section. As is also well understood, exposure to the light reflected from the non-image area of the original dissipates the charge on the photoconductive matrix section leaving the image areas charged. The continuous transportation of the photoconductive matrix carries it through a powder unit 18, at which point charged particles of toner are attracted to the negatively charged image, thereby causing a visual image to be obtained.

Before arriving at a transfer roller 20, the photoconductive matrix passes lamps 22 which partially neutralize the charge on the photoconductive matrix so that the image can be more easily transferred onto the copy paper. During the time that the photoconductive matrix is transported toward the transfer roller 20, a sheet of copy paper is fed out of the feeder 24 and up to the paper gate 26. Immediately before the photoconductive matrix reaches transfer roller 20, the copy paper is carried past the paper gate 26. Thereafter, as the copy paper is fed between the powder image photoconductive matrix and transfer roller 20, the image is transferred onto the copy paper, after which the step of fusing the toner defining the transferred image is performed.

Figure 2A:
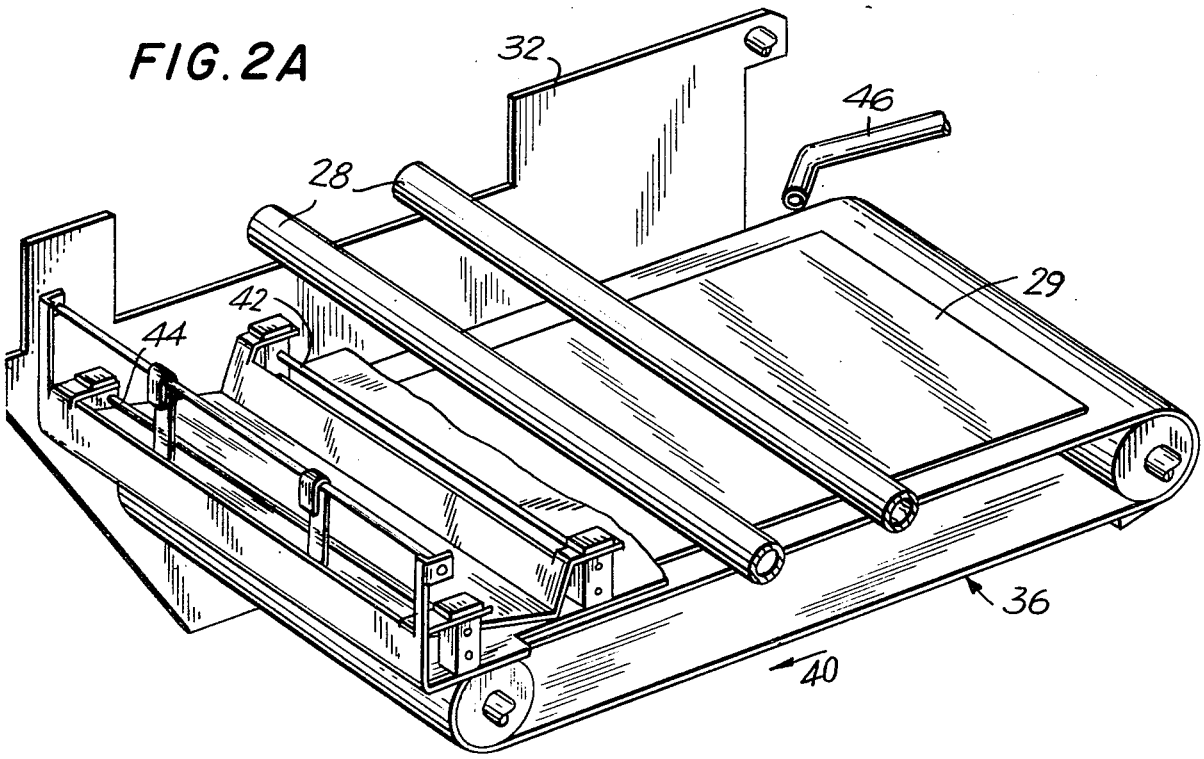
FIG. 2A is a diagrammatic view of the fuser device forming part of the copying machine and in which the system in accordance with the present invention has been incorporated.
Figure 2B:
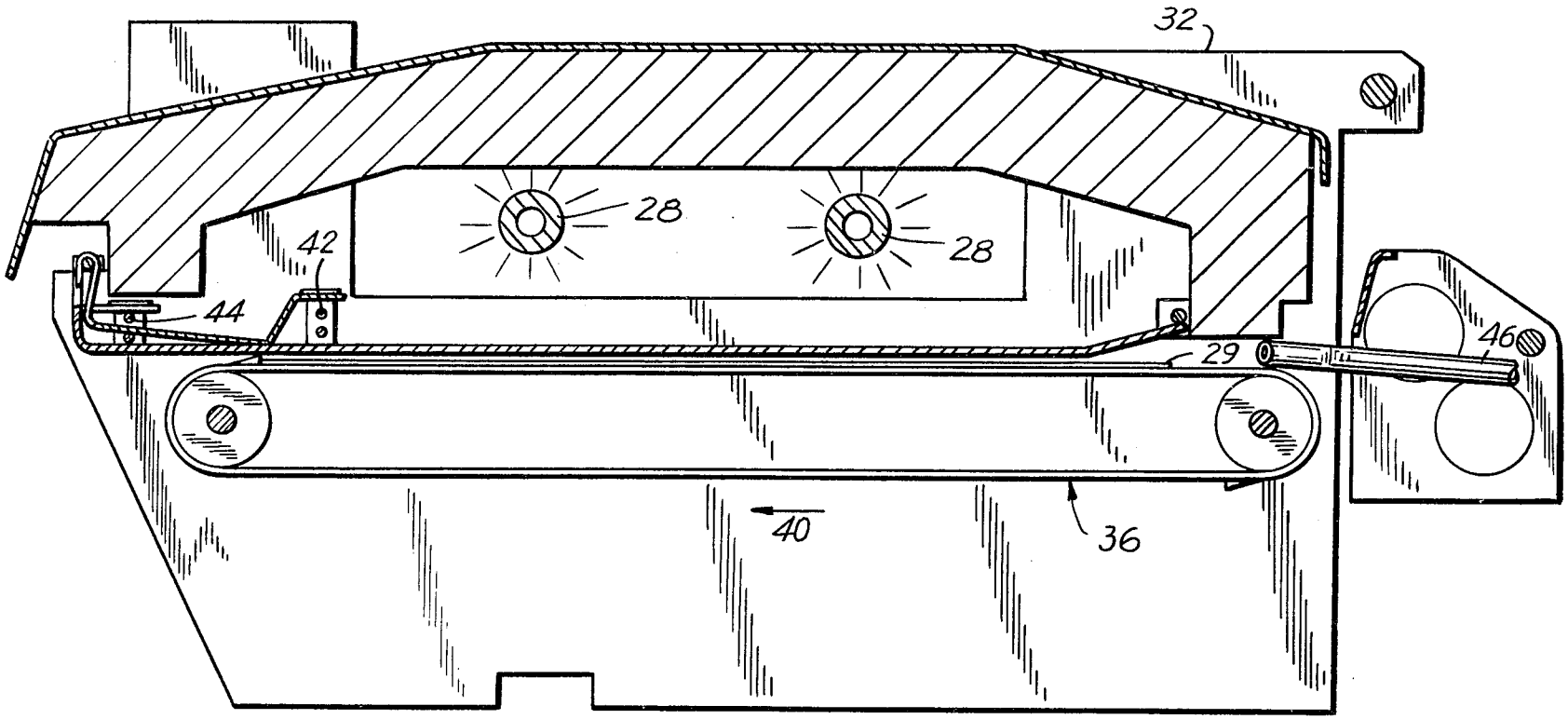
FIG. 2B is a sectional view of the fuser device seen in FIG. 2A.

Referring now to FIG. 2, there is illustrated in diagrammatic form, but in some detail, a fusing device 30 to which a copy sheet 29 has been fed so as to perform the step of fusing the toner which has previously been deposited in the appropriate pattern in accordance with the original document that has been copied. In the preferred embodiment fusing device 30 includes an outer housing member 32 enclosing a pair of heating elements in the form of infrared lamps 28. Gripper bars or similar means 36 advance sheet 29 in the direction of arrow 40.

Incorporated within the fusing device 30 as part of the fire detecting system in accordance with the present invention is a pair of electrodes 42 and 44 shown situated adjacent the exit end of the fusing device. It will be noted that each of the electrodes is defined by a pair of wires 42A and 44A, respectively, suitably connected to a source of power; and that the receiving electrode 44 has its wires at a slightly higher elevation than those of electrode 42; this is to reduce the amount of electrical noise received in the fuser due to static charge on belt 36. Also located adjacent the exit is a nozzle 46 which provides in accordance with the preferred embodiment, a source of coolant or fire extinguishing chemical that can be played on a copy sheet should that sheet catch fire and to be a source of danger.

Figure 3:
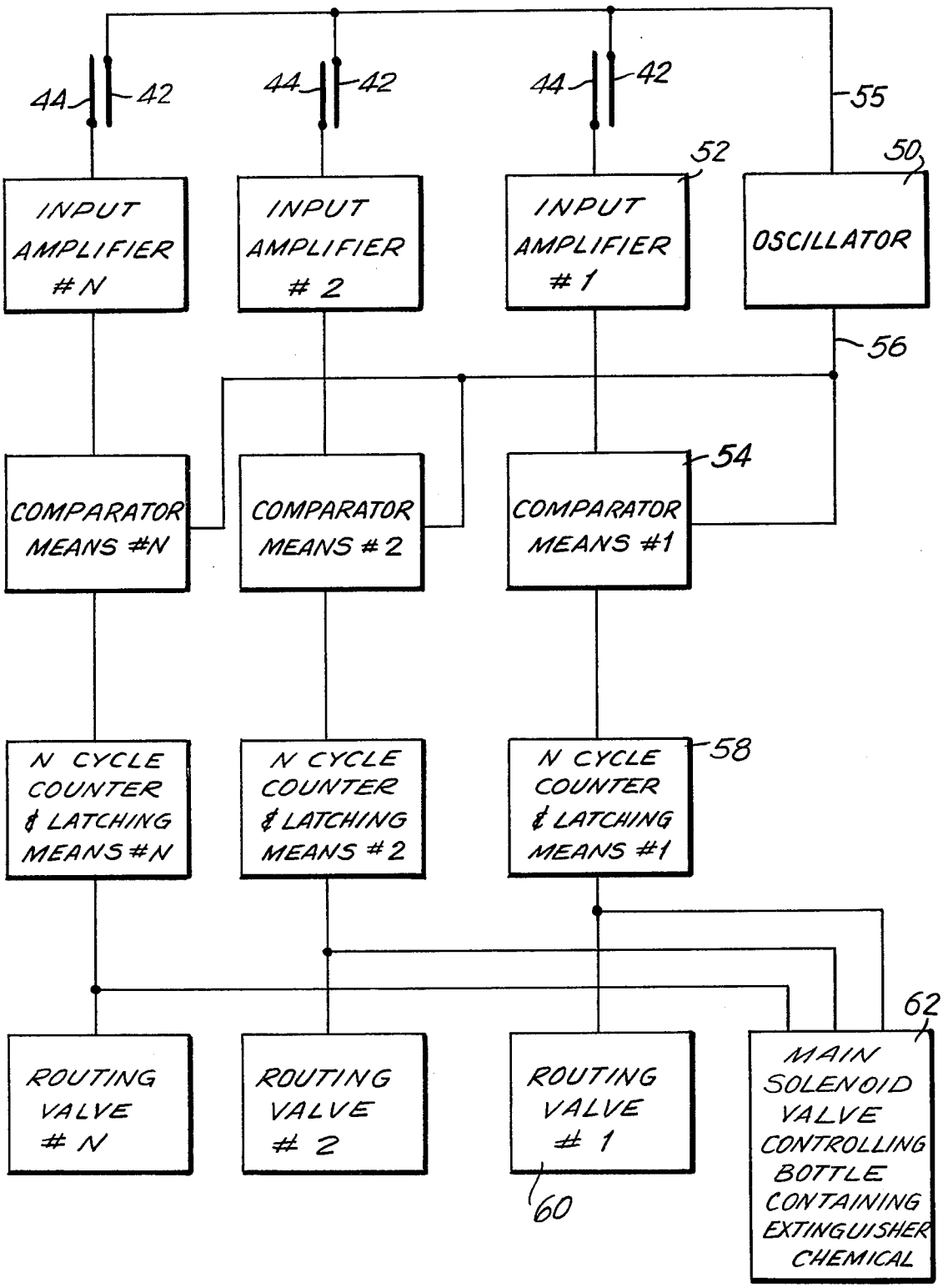
FIG. 3 is a block diagram of the detecting and extinguishing system of the present invention.

Referring now to FIG. 3, a block diagram is provided of the complete detecting and extinguishing system of the present invention. Seen at the upper end of the figure is the electrode means previously seen schematically in FIG. 2. However, in this block diagram of FIG. 3 a plurality of transmitter electrodes 42 are illustrated and a matching or corresponding set of receiving electrodes 44. The reason for this grouping of pairs of electrodes is so as to provide for selectively detecting and extinguishing a fire that may occur in various portions of the machine in the event that this should prove efficacious.

Each of the receiver electrodes 44 is respectively connected to one of the input amplifiers 52 in the individual channels or paths, and the outputs of the amplifiers are connected to comparator means 54, which are also designated No. 1, No. 2 and No. N, the last standing, of course, for any given number.

It will be noted that a first output is fed from oscillator 50, by way of line 55, to the transmitter electrodes 42. Another output taken on line 56 is applied to each of the comparators 54 for purposes to be explained. The outputs of the comparators are connected to N-cycle counters and latching means as illustrated, these means being designated 58. Each of the outputs of the latching means is connected to the input of a routing valve 60; furthermore, each of these outputs is also connected to individual inputs of a main solenoid valve 62 which valve controls the output from a bottle containing a suitable chemical, such as Halon 1211.

It will be understood that in addition to the connections to individual valves 60 and to the main solenoid valve 62, connections may also be made so as to produce the setting off of an alarm under emergency conditions, that is, when a fire has been detected in the copy machine; also, to shut off the AC power to the motor, fuser and other devices, but to keep on the 24 DC supply. However, the invention especially contemplates that the basic purpose be achieved of actuating appropriate valves so as to provide an extinguishing chemical at the portion of the copy machine where a fire has broken out.

As noted previously, the advantages of the detection system of the invention are that it is extremely simple to construct; moreover, it can work in almost any environment with the response time being of the order of 10 milliseconds or less; and the size of the electrodes 42 and 44 has very little effect on the input amplifier 52.

Figure 5:
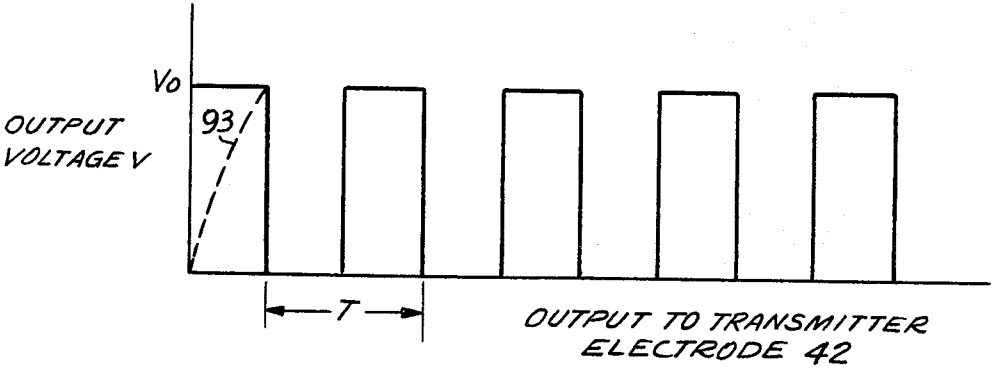
FIG. 5 is a pulse wave form put out by the wave generating device of the present invention.

The significant aspect of the detection system is that the presence of a flame, for example, due to a burning copy sheet, or parts of the machine such as belts or the like, will cause the gap between electrodes 42 and 44 to become ionized in accordance with a well-known principle. However, several parameters are judiciously selected such that the conductivity of the gap between electrodes 42 and 44 will be substantially increased to a point on the order of 1000 times the normal condition, that is, when no flame is present at the electrodes. Thus, the gap distance is selected to be approximately 0.2 inches and the pulse voltage magnitude about 24 volts. In connection with this aspect of the invention, it will be noted that FIG. 5 illustrates schematically the pulse voltage output or wave form that is transmitted from oscillator 50 to the electrodes 42 and correspondingly to the inputs of comparators 54.

It will thus be appreciated that the present invention provides a self-checking or verification arrangement involving the aforenoted application of a 300 cycle pulse form both to the electrodes 42 and to the comparators 54. By a specific arrangement to be described, it can be precisely determined if the characteristics of the signal received at the receiver electrode are the same as those put out by the oscillator 50. The received signal must exceed a threshold level which is determined by the input amplifiers 52. The amplified signal which is sent to comparators 54 is checked to see that it not only exceeds a predetermined level when the output voltage from oscillator 50 is at $V_0$ (FIG. 5), but is less than a second predetermined level when the output voltage is at zero. Both of these precise conditions must exist for some number of cycles to affect a discriminating means, in the form of a charged capacitor, which operates to generate a voltage level that can be compared to a reference. If the reference value is exceeded, the output driver, as symbolized by the block 58, is then latched on; this output driver then actuates either or both of the routing valves 60 and the main solenoid valve 62 (FIG. 3).

Figure 4:
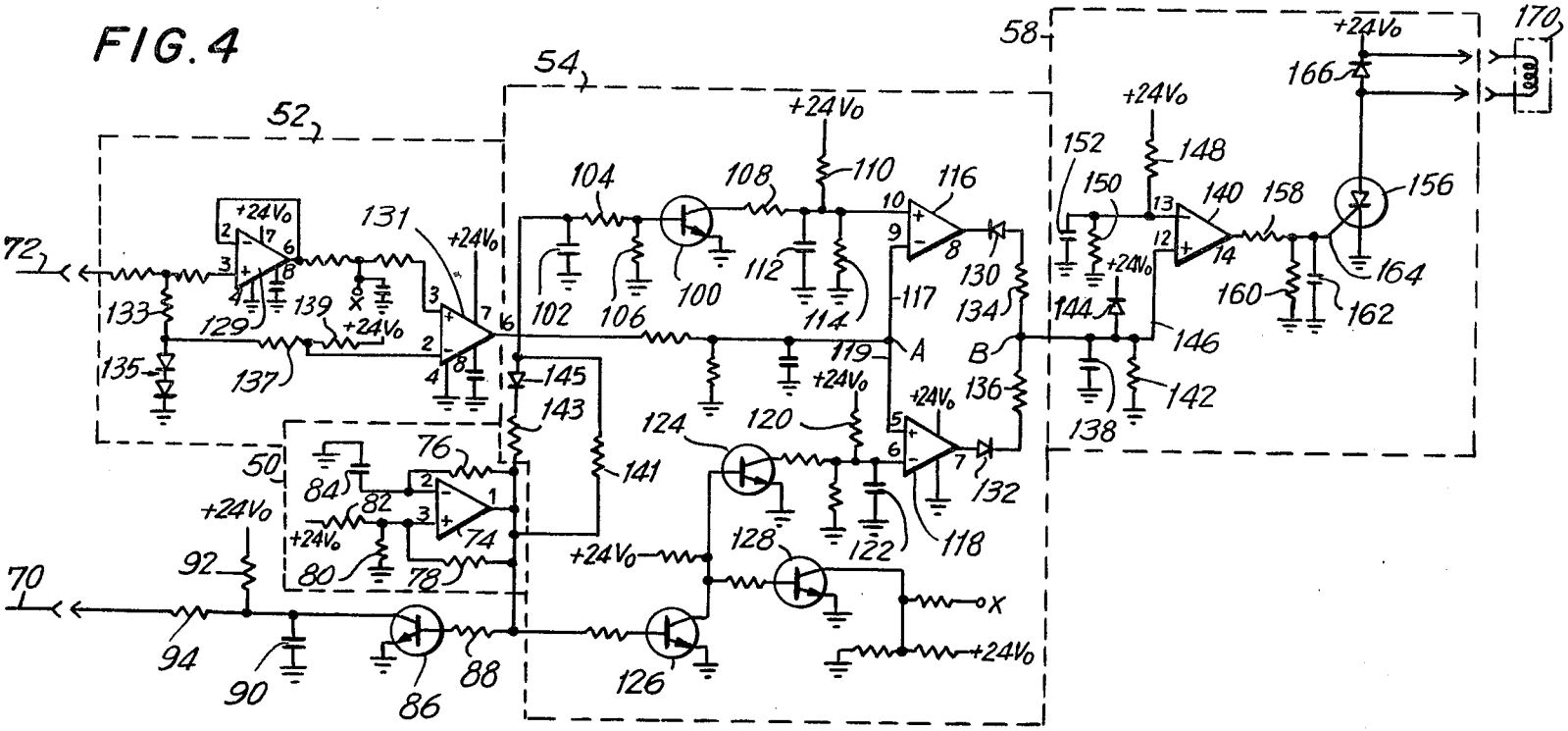
FIG. 4 is an electrical schematic diagram of the detecting system.

Reference now to FIG. 4 will make clear the detailed operation of the detection system. In this figure a schematic diagram represents the implementation of the block showing of FIG. 3. Thus, there is seen a transmitting line 70 which is connected to the transmitter electrode or electrodes 42 of FIG. 3. Correspondingly the receiver electrodes 44 are connected to the circuitry of FIG. 4 by way of receiving line 72. Appropriate DC connections furnish the required 24 volt DC supply ($+24\ V_0$) to the operational amplifiers designated by the triangular symbol seen in this figure, and also to the individual transistors and SCR requiring such DC supply. Suitable ground connections are likewise made to the aforesaid devices.

The oscillator or wave generating device 50 seen previously in FIG. 3 consists, as illustrated in FIG. 4, of an operational amplifier 74 suitably provided with input and output circuitry in the form of resistors 76, 78, 80, 82 and capacitor 84, all of these elements being appropriately connected to selected terminals of the operational amplifier 74. The output of operational amplifier 74 functioning as an oscillator is connected to transistor output stage 86 by way of resistor 88. The output of the transistor stage 86 is connected by way of an output network which includes capacitor 90, resistor 92 and resistor 94 to transmitting line 70. This network functions to modify the pulse form seen schematically in FIG. 5 such that a "rolling off" of the inherent steep rise is effectuated, as can be appreciated by reference to the dotted line 93 in FIG. 5. This "rolling off" is to reduce the signal coupled to the receiver electrode due to capacitive and inductive effects. The falling edge amplitude is opposite in polarity and can not cause false detection.

The output of operational amplifier 74 is also connected to two individual comparator devices which make up a particular comparator means 54 seen in FIG. 3. That is to say, for example, the comparator means No. 1 in FIG. 3 includes two separate comparator devices, one of which has the function of comparing the upper or maximum amplitude of a signal that is sensed at the electrodes 44 with a reference, while the other comparator has the function of comparing the lower value of the pulse or wave to determine if it, in fact, meets the previously noted criteria.

The first comparator device includes the input transistor 100 at whose input a network is provided consisting of capacitor 102 and resistors 104 and 106. A suitable output resistor 108 is provided for transistor 100, and an input biasing network comprising resistor 110, capacitor 112 and resistor 114 as seen at the input to an operational amplifier 116, which functions to provide the required comparison between generated and received signals.

Another input 117 for amplifier 116 is also utilized to provide signals from the receiving line 72, as will be explained. A similar input 119 is connected at from a common node A and to another operational amplifier 118 which is connected in a similar, lower, comparator device. This lower comparator device includes an input biasing network consisting of resistor 120 and capacitor 122 for the operational amplifier 118, and connected to this input is the output from a series or plurality of transistor stages 124, 126, 128. The input transistor 126 receives the same output from oscillator 74 as was applied to the upper comparator device which includes the operational amplifier 116. Each of the individual transistors 124, 126 and 128 is connected in a common emitter configuration and is provided with appropriate input biasing as well as output networks. An output point X, at the output of transistor 128, is shown connected to the same point X at the output of operational amplifier 129 serving as a voltage follower or buffer input to another operational amplifier 131 functioning as the main amplifier for the received signal from line 72.

The amplifier 131 also functions as a comparator so as to compare the signal received at terminal 3 of the amplifier 131 with that at terminal 2, as received from a level setting means which includes a resistor 133, a pair of diodes 135, resistor 137, resistor 139, and the source of supply, $+24\ V_0$. This level setting means insures that any noise that may arise will be amplified in equal manner whether the noise occurs during the ON or the OFF time for the generated pulse form illustrated in FIG. 5.

It is also to be noted in connection with the input configuration of transistors 124, 126 and 128 which transmit signals to comparator 118, that these operate to provide the required inversion of signals being transmitted to comparator 118 and also provide level shifting. As noted previously, this level shifting at point X is fed back and connected to the output of the buffer amplifier 129 thereby again to insure the equal amplification of both noise and signal regardless of when the noise may occur; that is, whether it is during the ON or OFF time of the transmitted pulse form an oscillator 50.

Because of the delay involved in the transmission through the network involving the transistors 124, 126 and 128 to comparator 118, a compensating delay means is provided in transmitting the output of oscillator 74 to the upper comparator device 116. Thus, a simple delay means is arranged, including a resistor 141 and, in shunt therewith, resistor 143 and diode 145.

The individual outputs from operational amplifiers 116 and 118 are commoned together at node B by way of oppositely poled diodes 130 and 132 and by way of respective resistors 134 and 136. From node B connection is made to capacitor 138 which in turn is connected to ground. It is this capacitor which has the function of discriminating so as to determine whether a particular number and kind of pulses are being received at the outputs from the operational amplifiers 116 and 118 so as to effectively monitor or check on the condition at electrodes 42 and 44. That is, to check to determine whether or not a flame is actually present between these electrodes such that in the former case, the precise signal put out by oscillator 50 should be received from the receiver electrodes. Otherwise, such as in a case of a spurious signal that might somehow originate at an electrode or inadvertently within some of the circuitry, such spurious signal will not have the precise characteristics of the signal put out by oscillator 50 and hence will not be recognized as flame-indicating. Capacitor 138, which performs the aforesaid function, is connected to one input of an operational amplifier output stage 140, functioning as a comparator, by way of an input network comprising resistor 142 and diode 144, connection being made to one of the inputs of operational amplifier 140 by means of line 146.

The other, reference, input to operational amplifier 140 includes resistors 148, 150 and capacitor 152. The output from operational amplifier 140 is connected to latching device 156, in the form of an SCR or the like, by way of output resistor 158 and input network consisting of resistor 160 and capacitor 162. The aforesaid elements are, of course, connected to the control electrode 164 of the SCR, the anode of such device 156 being taken by way of diode 166 to the DC supply. A solenoid 170, which functions to control valve 62 (FIG. 3) on a fire extinguisher bottle or the like, is seen at the upper right of FIG. 4, being connected to the DC supply and in shunt with the diode 166.

The reference level at the input to amplifier 140 is set at approximately 8 volts so that when the input level on the line 146 rises to a value equal to a greater than 8 volts the output of this amplifier 140 will go high thereby to actuate the SCR 156.

OPERATION

Should a fire break out within the copy machine due to, for example, a copy sheet bursting into flame, or from a similar cause, it will take only approximately 10 milliseconds for the flame bridging the gap between electrodes 42 and 44 to be detected. In such event, the same signal as is being transmitted from oscillator 74 in FIG. 4 to electrode 42 is also being received at pin 2 of operational amplifier 131 from the receiving line 72 which is connected to electrode 44. The input signal level is shifted, as already described, before being impressed at pin 2. It is thereafter amplified and transmitted to the dual comparator including the individual comparators 116 and 118. Comparator 118 effectively looks to see whether or not the prescribed pulse duration and other characteristics are present. That is to say, whether an on-time of approximately 1.5 milliseconds followed by an off-time of approximately equal time has occurred, and if this has occurred for approximately three cycles. Of course, the setting or counting of the number of cycles is purely arbitrary and can be varied as desired. However, only if the prescribed characteristics are satisfied will the capacitor 138 build up a charge sufficient to create a proper bias or input at pin 12 of the operational amplifier 140 so as to cause its output to go high and to turn on SCR device 156.

In the event that the pulse form is not proper, such as, for example, if it involves a wider pulse than that illustrated in FIG. 5, then the false pulse will continue to be high during the time when there is substantially zero or no signal being transmitted from oscillator 74. In that event it will happen that comparator 116 in the upper comparator circuit will have its output at ground and this will result in discharge of any previously built up charge on capacitor 138. Accordingly, the result is that the SCR 156 will not be improperly triggered because of the spurious signal. Similarly, in the event of a too narrow pulse, or otherwise inappropriate pulses, the capacitor 138 again will not be enabled to build up sufficient charge to trigger the SCR 156. The fact that the resistor 136 at the output of comparator 118 is chosen to be approximately thirty times greater than resistor 134 aids in the discriminating function.

DETAILED SPECIFICATIONS

In order to provide the man skilled in the art with a detailed set of specifications for practicing the electrical circuit of FIG. 4, the following listing is given of types and values for certain of the components involved:

| Operational Amplifiers | Capacitors |
|---|---|
| 74 U3a-LM324 | 84 .033 μF |
| 116 U3c-LM324 | 102 .22 μF |
| 118 U3b-LM324 | 112 .001 μF (1 kv) |
| 129 U1-LM308 | 122 .001 μF (1 kv) |
| 131 U2-LM308 | 152 .01 μF (±20%) |
| 140 U3d-LM324 | 162 .01 μF (±20%) |

| Transistors and SCR | Diodes |
|---|---|
| 86 2N4400 | 145 IN4148 |
| 100 2N4400 | 130 IN4148 |
| 124 2N4400 | 132 IN4148 |
| 126 2N4400 | 144 IN4148 |
| 128 2N4400 | 166 IN4002 |
| 156 2N1596 | |

| Resistors | |
|---|---|
| 92 2.7 k ohm | 104 33 k ohm |
| 94 2 k ohm | 106 72 k ohm |
| 133 5.6 m ohm | 108 39 k ohm |
| 139 20 k ohm | 110 20 k ohm |
| 137 680 ohm | 114 220 k ohm |
| 82 100 k ohm | 120 20 k ohm |
| 80 100 k ohm | 134 1 k ohm |
| 76 62 k ohm | 136 33 k ohm |
| 78 100 k ohm | 150 100 k ohm |
| 88 10 k ohm | 142 240 k ohm |
| 143 360 | 148 200 k ohm |

-continued

| | |
|---|---|
| 141 82 k ohm | 158 2 k ohm, ½ |
| | 160 360 |

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A flame ionization detection system for detecting a flame from a burning copy sheet or the like in a copying machine, such system comprising:

means defining a path of travel for said copy sheet;

first and second electrodes operatively associated with said travel path and spaced closely adjacent thereto for detecting any ionization resulting from the occurrence of a flame adjacent the path of travel;

signal generating means coupled to said first electrode for generating pulse signals having a predetermined magnitude and frequency;

signal receiving means coupled to said second electrode for receiving said pulse signals; and comparator means coupled to said signal generating means and to said signal receiving means for determining if the pulse signals received are above a threshold level and so correspond in all respects to the pulse signals transmitted to said first electrode that they are indeed flame indicating.

2. A system as defined in claim 1, in which said copying machine includes a heat operated fusing device for fusing toner to a copy sheet and in which said first and second electrodes are located within said fusing device for detecting the presence of flame.

3. A system as defined in claim 2, in which latching means are connected to the output of said comparator means and a cycle counter is provided for counting the number of predetermined pulses received by said signal receiving means so as to set said latching means.

4. A system as defined in claim 3, in which a solenoid means is connected to the output of said latching means, said solenoid controlling a valve for supplying a coolant or fire extinguishing chemical.

5. A system as defined in claim 4, in which a nozzle is connected to said valve and is disposed within said fusing device to direct the coolant on the flame.

6. A system as defined in claim 1, in which additional pairs of sending and receiving electrodes are spaced in a variety of locations within said copying machine and corresponding signal generating, signal receiving, and comparator means are connected respectively to each additional pair of electrodes.

7. A system as defined in claim 6, in which individual latch means are connected to each of said comparators and individual routing valves are connected to each of said latching means; and further comprising a main solenoid valve connected to all of the latching means.

8. A system as defined in claim 1, in which the frequency of the pulse signals is of the order of 300 cycles/sec.

9. A system as defined in claim 1, including a discriminating means for determining if an appropriate number of pulses matching the characteristics of the generated pulse signals has been received, said discriminating means being connected to the input of said latching means.

10. A system as defined in claim 9, in which said discriminating means includes a capacitor.

11. A system as defined in claim 1, further comprising an amplifier as part of said signal receiving means for amplifying signals only above a predetermined threshold.

12. A system as defined in claim 11, further including a level setting means connected to one input of said amplifier.

* * * * *